US006439275B1

(12) United States Patent
Alhomsi

(10) Patent No.: US 6,439,275 B1
(45) Date of Patent: Aug. 27, 2002

(54) AUTOMATIC CONNECTION SYSTEM AND METHOD

(76) Inventor: Abdullah Alhomsi, Sidensvansvägen 29, SE-871 65 Härnösand (SE)

( * ) Notice: Subject to any disclaimer, the term of this patent is extended or adjusted under 35 U.S.C. 154(b) by 0 days.

(21) Appl. No.: 09/448,726

(22) Filed: Nov. 24, 1999

(51) Int. Cl.[7] ..... B67D 5/00

(52) U.S. Cl. ..... 141/94; 141/98; 141/231; 191/4

(58) Field of Search ..... 141/94, 98, 231, 141/232; 191/4

(56) References Cited

U.S. PATENT DOCUMENTS 4,129,203 A * 12/1978 Berman ..... 191/4
5,332,013 A * 7/1994 Sugita et al. ..... 141/98
5,507,326 A * 4/1996 Cadman et al. ..... 141/231
5,634,503 A * 6/1997 Musil et al. ..... 141/232
5,671,786 A * 9/1997 Corfitsen ..... 141/94
5,944,069 A * 8/1999 Nusbaumer et al. ..... 141/94
6,024,137 A * 2/2000 Strnad et al. ..... 141/94

* cited by examiner

*Primary Examiner*—J. Casimer Jacyna
(74) *Attorney, Agent, or Firm*—Ware, Freesola, Van der Sluys & Adolphson LLP

(57) ABSTRACT

An automatic connection system provides for the transfer of energy, gas or liquid fuel between two units of which at least one can be mobile. The system has one transfer part or cable which is at least partially elastic and at least partially rigid and a receiver device that is funnel-shaped with successively tapering or successively tapering successively turned cross-sections. An input device on the transfer part or cable operates as a codeable, secure, self-connecting connection device. An output device is affixed to the receiver device. The system can utilize a cable winder or another suitable extension and retraction mechanism for extension and retraction of the cable.

38 Claims, 6 Drawing Sheets

AUTOMATIC CONNECTION SYSTEM AND METHOD

BACKGROUND OF THE INVENTION

1. Technical Field

The invention at issue relates to connection systems for the transfer of liquid fuel, gas or energy between two units of which at least one can be mobile, for example, car—utility electric supply outlet, automobile—fueling station, two railway cars, battery-driven forklift—charging station or armored tank—fueling vehicle.

2. Description of the Background Art

An automatic connection functions without any direct manual intervention. This is advantageous when, for instance, the driver cannot leave the vehicle, e.g. when refueling a tank, to obtain greater reliability during the connection process itself, e.g. when connecting a vehicle to a power supply or when greater convenience is desirable.

Efforts have been made to create a linkage or connection system for mobile units and have resulted in some applications. Devices for refueling aircraft in flight are an example where monitoring and positioning are required for the connection process. Another example is the automatic fueling of vehicles based on advanced robot and scanning technology. For practical utilization in common applications, e.g. connecting the utility electric supply or a fuel supply, a connection system requires: (1) low production, operation and maintenance costs which in turn requires simple constituent components; (2) no need for monitoring; (3) no need for position adjustment to achieve the exact connection position, i.e. a realistic degree of tolerance for divergent or crooked parking or placement of the vehicle; (4) minimal risk of damage to both the vehicle and the connection station upon connection; (5) ease of use; (6) relatively small dimensions in particular for that part of the system that is installed in the mobile unit or vehicle; and (7) coding the system to limit unauthorized use or to ensure that the connection is made to the correct source, e.g. correct octane rating, or for other safety reasons.

To date, no such automatic connection system has existed due to, among other factors, the inherent conflicts between the above-mentioned requirements. The difficulty has largely been the creation of a simple system that does not require exact parking and, at the same time, is of small dimensions at a low manufacturing cost.

SUMMARY OF THE INVENTION

The purpose of the presented invention is to achieve an automatic connection and transfer system for energy, gas or liquid fuel between two units of which at least one can be mobile. It shall, to the greatest possible extent, consist of simple components, where the connection can be achieved within a given range of distance variation in the placement of the mobile unit. It shall be safe and easy to use, of relatively small dimensions and where the transfer can only be undertaken after the connection between the system parts is fully accomplished.

This purpose is achieved by means of a connection system according to the presented invention that incorporates several constituent devices and demonstrates the characteristics as stated in the patent claims. The connection system is first described below and thereafter illustrated by examples including related drawings prior to presentation of the patent claims.

The presented invention is an automatic connection system or the transfer of energy, gas or liquid fuel between two units of which at least one can be mobile and encompasses:

One from the first unit extendible and at least partially rigid at least partially elastic transfer element therein or at energy lines or hose or such like and a coded input device are affixed or built-in—hereafter the "cable", and a receiver for the cable, hereafter the "receiver", that can be fixed on a wall, on a post mounted on a foundation or on a moveable mechanical device or in the other mobile unit, and the task of which is to accept the introduced cable and its input device and steer or guide it to an output device that can identify the input device and transfer energy, liquid fuel or gas between the receiver and the cable.

The cable characteristics named above can be achieved e.g. via one at least partially rigid and/or at least partially elastic casing that is affixed/built-in at least at one section of the cable. For example, a spiral casing of suitable plastic, metal or composite material, and/or one at least partially rigid and/or at least partially elastic core or reinforcement, e.g. a core of suitable plastic, metal or composite material is affixed or built-in to at least one section of the cable, and/or at least one section of the affixed conduits in/at the cable possesses suitable elasticity and/or rigidity characteristics, or by any other means or combination of means and material that permit the cable, upon extension towards the receiver, to bridge a given varying distance between said cable's initial position and the receiver component, and/or allow a given variation of angle between the cable's axle in its initial position and the receiver. The cable's partial rigidity also makes it possible to transfer at least part of the force applied to extend the cable to the receiver and input device to pass the cable through the receiver and into the output device in order to create a connection between the input and output devices.

The receiver is comprised of one or several funnel or trumpet-shaped devices, circular or non-circular, closed or open cross-sections- hereafter known as the "funnel" or "funnels"—for receiving and guiding the cable. This facilitates the connection between the input device and the output device or one of the output devices in/at the receiver. The receiver can be comprised of e.g. at least one tapering channel or tube and/or at least one curved tapering channel or tube, for example a spiral channel that receives the inserted cable—whereupon the input device is affixed or built-in—and is allowed to extend, be forced or crawl through its first cross-section and through the funnel's subsequent parallel cross-sections of which at least one part is—in comparison with at least one preceding parallel cross-section—successively tapering, and/or also in relation to the axis formed by the cable's free end when it enters into the first receiving section—successively displaced and/or in relation to the axis—only successively turned. The receiver in its entirety, or one or several of the funnels, can be moveable or flexible to facilitate the cable's movement towards the output device.

The cable can be retracted and extended plus accommodated by a variety of retraction and extension devices that are installed in one of the units between which the transfer can be made, hereafter the "extension device". The cable can e.g. be retracted and extended by means of a transfer of force between an extension mechanism and a device that is affixed or built-in at the cable e.g. by means of a cog in/at the cable and a transmission cogwheel. The cable can also be retracted and extended by means of one or more suitable wheel(s) that apply pressure to the cable and are driven by a suitable power unit. A third method is comprised of a housing, a cable winder, consisting of two cylinders of different diameters of which the smaller is mounted inside the larger. The space between the cylinders accommodates the "cable".

Upon rotation of the cable winder on its rotation axle, the cable is extended or retracted respectively. The cable is fixed to the cable winder at or near one of its ends while the cable—at or near its other, free end—carries the input device, which together with the output device in the receiver constitute the system's connection device. The cable's fixed end is connected to a service outlet for the transferred energy, gas or liquid fuel via e.g. a slip ring connector or other suitable connection device. Retraction and extension of the cable can be achieved by an electric motor which causes the cable winder to rotate and forces the cable first out of the cylinder through e.g. a channel and/or opening in a foundation, whereupon the cylinder and its housing are mounted, i.e. out of the connection system's extension device, and then by means of the cable's partial rigidity across the distance or gap between the extension device and the connection system's receiver part, and finally into the latter named where the connection between input device carried by the cable and the output device in the receiver can be accomplished. Retraction and extension of the cable can be controlled by a known device, e.g. a suitable load-limiting device on the electric motor—that is activated when the cable is fully retracted or extended, and/or when at least one guide zone is affixed to or at the cable to guide retraction and/or extension, i.e. for cessation of retraction and/or extension when the cable is fully retracted or extended respectively. Extension of the cable can also be terminated earlier, if the input device has affected the connection with the output device, via receipt—from the receiver—of an optic or electric signal or current in the cable's electrical wiring or in the conduit(s) specifically intended for this purpose or change in pressure in its accommodated hose-pipe is used directly or indirectly e.g. to cut the current to the extension mechanism by means of e.g. a cut-off relay or switch.

The output device in the receiver is, when disengaged, in an idle state and can be activated after or via introduction of the associated intended coded input device whereafter a locking mechanism is triggered to lock the input device in the output device and/or activate a transfer mechanism for transfer of fuel, energy or gas. This activation can occur e.g. by means of a continual, fixed electric or optic signal or by means of another electrical, mechanical or electromechanical code that is affixed with the input device and is read by corresponding code reading device in or at the output device that activates the locking and/or the transfer mechanism by means of one or more suitable devices e.g. relays.

In one embodiment of the invention the input device is equipped with a coding device comprised of a given number of code elements of which at least one part is differentiated with respect to at least one physical property e.g.: electrically conductive/non-electrically conductive or transparent/non-transparent or magnetized/demagnetized or light-reflective /non-light-reflective. Each code element represents a binary value as a 1-code element or a 0-code element dependent upon the presence or absence respectively of a given physical property. The code elements are introduced in/at the input device in a given sequence and can be described with a vector or a matrix, hereafter the "key matrix"—cf. barcode. The value of a given matrix cell in the said matrix can be 1 or 0 dependent upon the binary value of the corresponding code element. At least one of the input device's code elements can be exchanged for another suitable external code element or change value or switch state with another by means of some other effect e.g. via change of place, offset, dislocation, twisting, rotation or such like which can give rise to a change in the key's binary value and therewith the binary value in one or several cells in the key matrix. The associated code reading device consists of a given number of code reading elements in a given sequence which can be described as a reading vector or reading matrix. Each code reading element consists of an energy input point—e.g.: an electric point, a light emitting diode or some other suitable recognized device. More specifically, an input point and a suitable known reading device for verification or testing for the presence or absence of a given physical property, e.g. an electric point, a phototransistor, a reed relay or some other suitable known device, which results in energy at an output point only upon the given presence/absence of the same given physical properties. Upon a stated intended introduction or contact between the input device and the reading device the code reading elements test a corresponding given intended number of code elements in stated positions in the input device which constitute at least one part of the total number of code elements in the input device which results in the presence of energy in the output points that test 1-code elements. More specifically 1-output points and absence of energy in the output points equivalent to 0-code elements more specifically 0-output points, which can be described with a corresponding binary value in the corresponding cell in the reading matrix. The binary value of at least one part of all reading matrix cells in a given sequence constitute a binary reading value for the input device and can be applied for identification of the input device via comparison with at least one stored binary value, alternatively at least one, mechanically and/or electrically and/or magnetically, pre-programmed binary value. More specifically an authorization value, which upon correspondence controls one or several switches, circuit-breakers or such like, e.g. one or several relay-controlled switches that carry current directly, or indirectly activate a mechanism to carry current to an electrical, electromechanical or similar device, for example an electric motor or an electromagnet, that affixes a locking and/or a connection mechanism, which by mechanical, electromechanical or other means locks the input device in/at the output device and/or connects an intended mechanism for the transfer of gas, liquid fuel or energy from the input device to the output device, from the output device to the input device or from either to an intended application within or outside the connection device. Disconnection occurs via an indirect disturbance of one or more of the conditions which control code reading by e.g. dragging the input device which causes one or more code elements to change their positions in relation to the code verification's input and output points or via direct effect on one or several of the above-named switches or circuit breakers. For example, via breaking of the continual activation signal or transmission of a deactivation signal which causes the current to the locking and/or connection mechanism to be broken and the output device to return to its idle state plus that the input device is released from the output device and can be withdrawn completely from the same without risk of electric arcs or fuel spill.

The read value of at least one part of the input device's code elements can be obtained via a parallel simultaneous reading or via a given serial sequential reading that is performed while the input device is introduced into the output device/reading device. Upon non-correspondence between reading value and the stored or programmed value (s) an alarm can be activated until the input device is withdrawn from the code reading device, alternatively, until a correctly coded input device is introduced or until some other predefined event occurs.

The code system's reading device can be in a non-active, idle state until it is activated by the partial or complete introduction of the input device into the output device. Activation can occur by means of a known mechanical, electrical, magnetic, optic or other activation device, e.g. a switch, whereafter code reading can begin. In cases where an electric or electromechanical or optic code reading device is used, it can receive current via the input device which means that the connection between the input and output devices cannot occur unless the input device supplies current to the code reading device in the output device whereafter code reading can be performed. In another embodiment, at least one of the connection device's electrical connections and/or at least one part of the code system's reading contact points consists of one or more springs the axle/axes of which are in a plane which forms an angle to the input device's introduction axle that is between 0 and 90 degrees. The same spring or springs are pushed aside by the introduction of the input device into the output device and rest on the corresponding contact ring in the input device when the same is completely inserted into the output device. At least of the above mentioned springs can be movable and is closed at the input device when the connection or the locking mechanism is activated and at least one spring can partially or entirely enclose the input device to achieve a flexible contact. The use of springs in the output device facilitate the introduction of the input device and/or create a flexible electrical and/or locking connection.

The invention is described in more detail below with reference to the appended drawings that schematically illustrate the invention concept and the invention's constituent parts. The description below with related drawings are one example of many applications and are limited to some applications.

DETAILED DESCRIPTION OF THE INVENTION

Figure 1A:
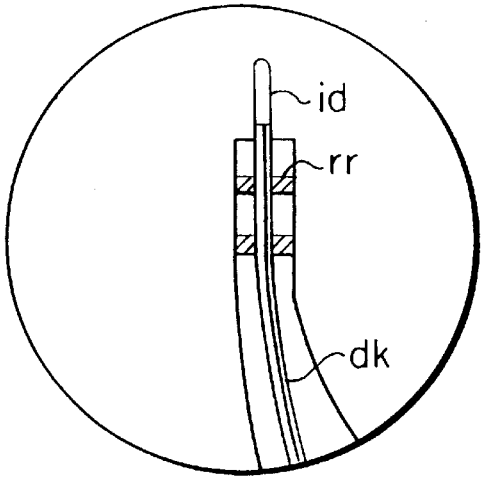
FIGS. 1, 1A, 1B and 1C show a connection system comprised of a cable, a receiver part, an extension device and a contact device.
Figure 1:
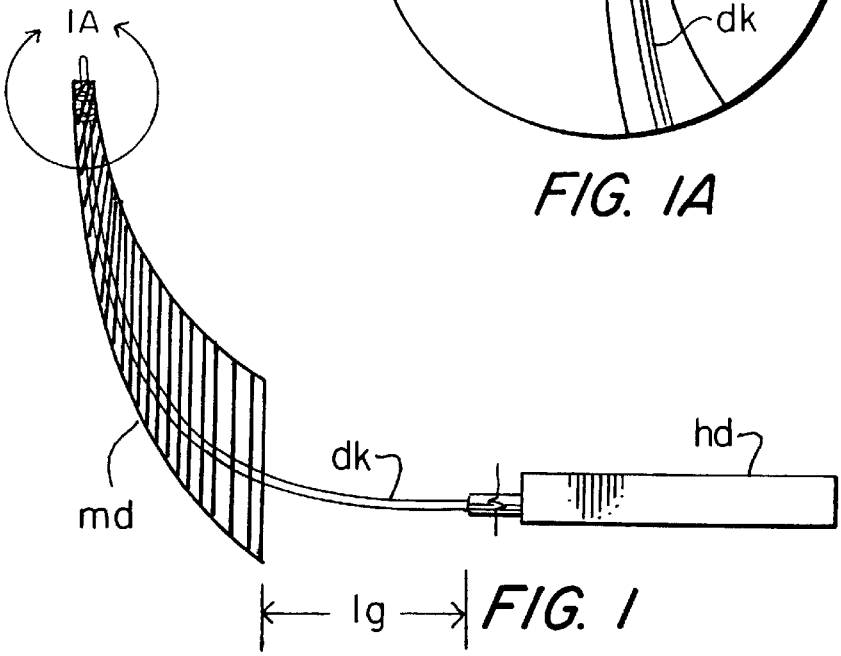
Figure 1B:
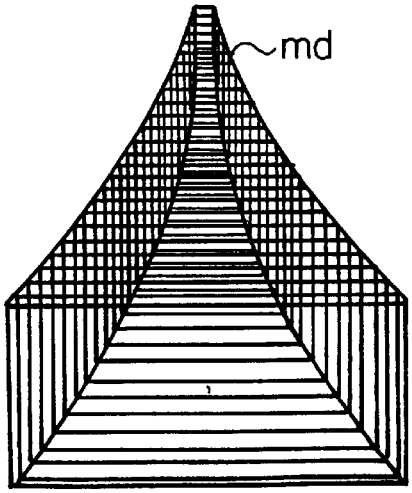
Figure 1C:
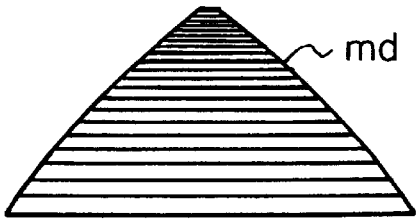
Figure 2:
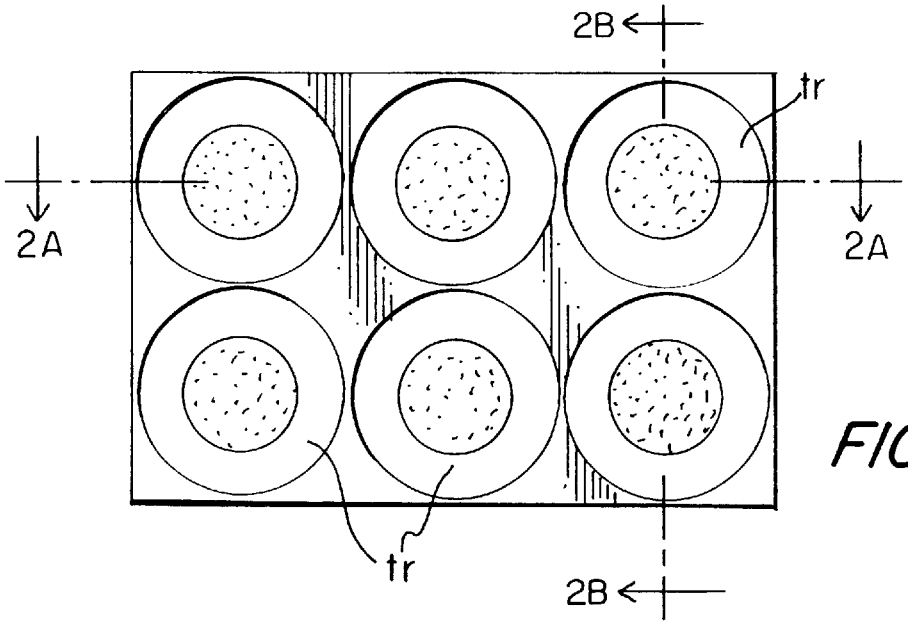
FIGS. 2, 2A and 2B show another receiver design.
Figure 2A:
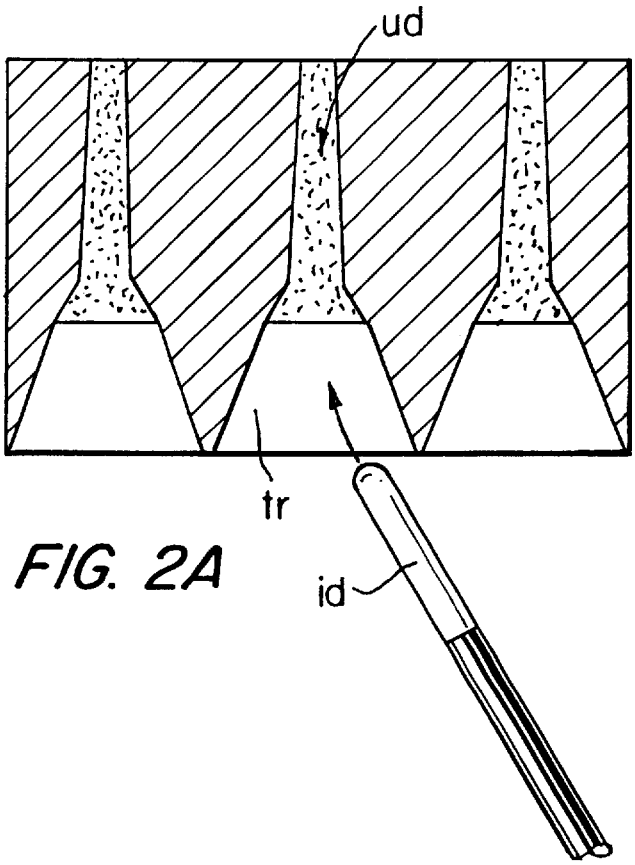
Figure 2B:
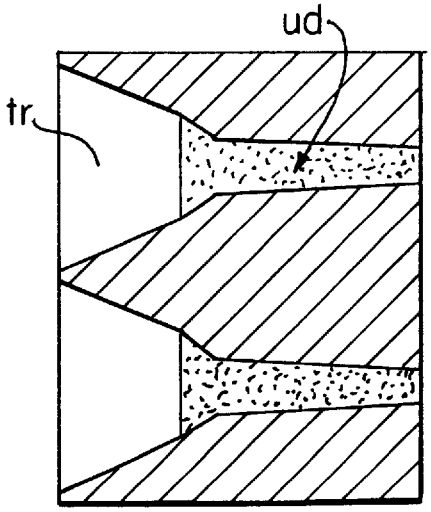

The connection system in FIGS. 1, 1A, 1B and 1C consists of four parts: a cable (dk) whereupon its free end an input device (id) is affixed, a receiver part (md) whereupon an affiliated output device can be mounted and an extension device (hd). FIG. 1 shows the extension device (hd) with the cable extended across the gap (lg) and in the receiver (md) that is funnel/trumpet-shaped with successively tapering, successively displaced, cross-sections along the cable's route. FIG. 1 shows the input device (id) schematically only on the partially rigid partially elastic cable's free end without however the affiliated output device. FIG. 1A also shows how a guidance device (rr) can be affixed just before the output device in the receiver to achieve exact guidance of the input device/output device which in this example consists of two cylindrical brushes. FIGS. 2, 2A and 2B show another embodiment of the receiver in three different projections. The receiver in this case is comprised of six different funnels that are straight, tapering pipes. Each funnel (tr) can lead the input device (id) to its output device (ud) upon extension of the cable (dk).

Figure 3:
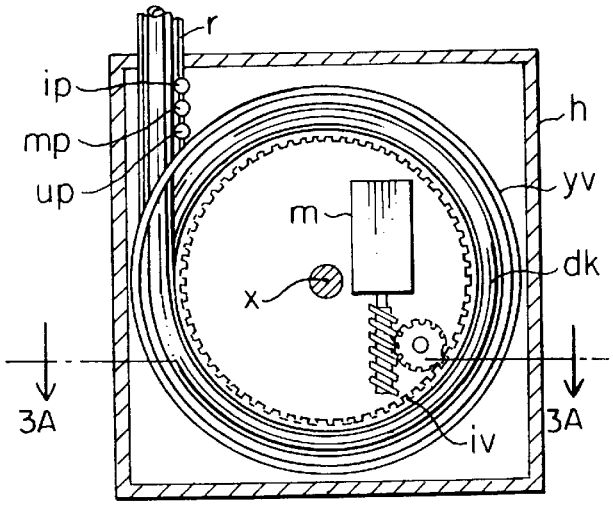
FIGS. 3, 3A, 3B, 3C and 3D show an extension device in the form of a cable winder.
Figure 3A:
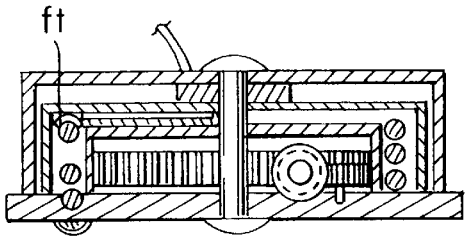
Figure 3B:
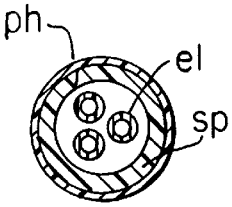
Figure 3C:
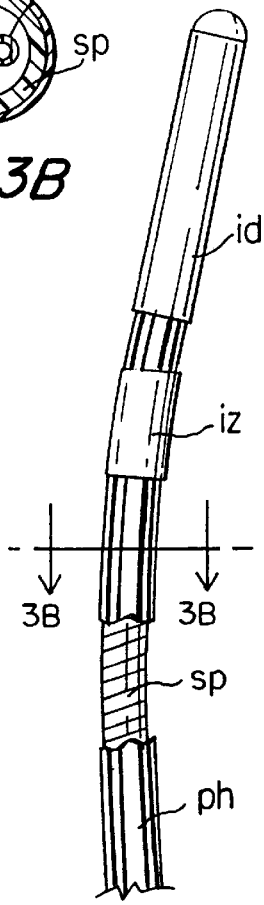
Figure 3D:
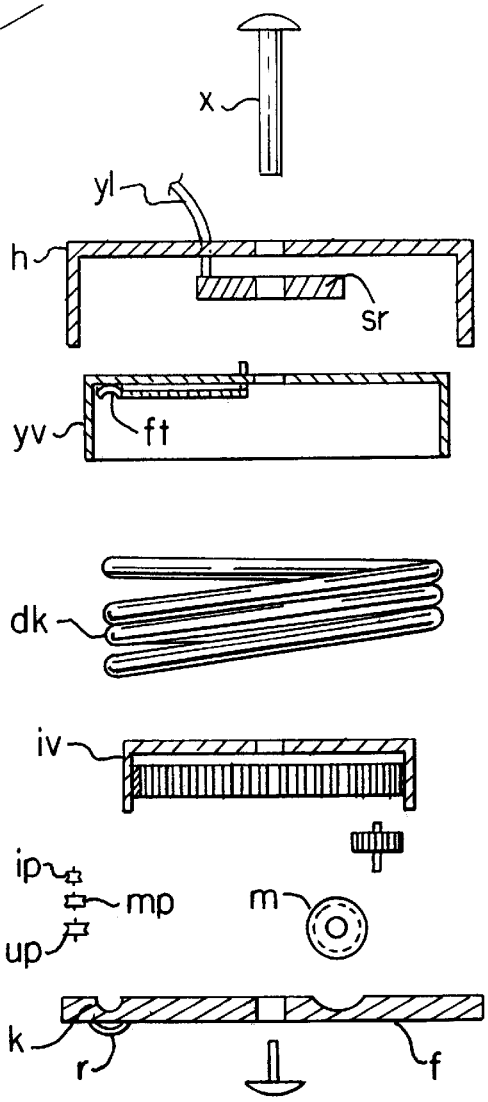

FIGS. 3, 3A, 3B, 3C and 3D show an extension device associated with a design of the invention intended for current transfer which consists of a cable winder resting on its foundation, a cross-section along line 3A–3A, the components of the extension device separated from each other, plus the cable and a cross-section of the same. The housing (h) of the extension device contains an outer cylinder (yv) and an inner cylinder (iv) that are rotated by the motor (m), assisted by a worm gear and a cogwheel, around the shaft (x) that is mounted in the housing (h) and the foundation (f). During clockwise rotation, according to FIG. 3, the at least partially rigid at least partially elastic cable (dk) is extended. Said cable has one end fixed in the cable mount (ft) that is connected to the slip ring device (sr) which in turn is connected to the external supply cable (yl)—out via a channel (k) in the foundation (f) and then through a pipe or hose-pipe or the like (r). Counterclockwise rotation results in the retraction of the cable (dk) which in this example carries an input device (id) at its free end, from the affiliated connection device in the funnel. The cable (dk) consists in this example of a non-electrically conductive casing (ph), an inner partially rigid partially elastic spiral casing (sp) that accommodates three electrical cords (el). FIG. 3C also shows a retraction zone (iz) near the cable's free end which in this example is an electrically conductive exterior casing of limited length and which is identical to the extension zone near the cable's fixed end. The same FIG. 3 shows three control points which are two retraction and extension points (ip, up) plus an electrified input point (mp). These three points consist of three electrically conductive wheels or balls in constant contact with the cable (dk).

Figure 4:
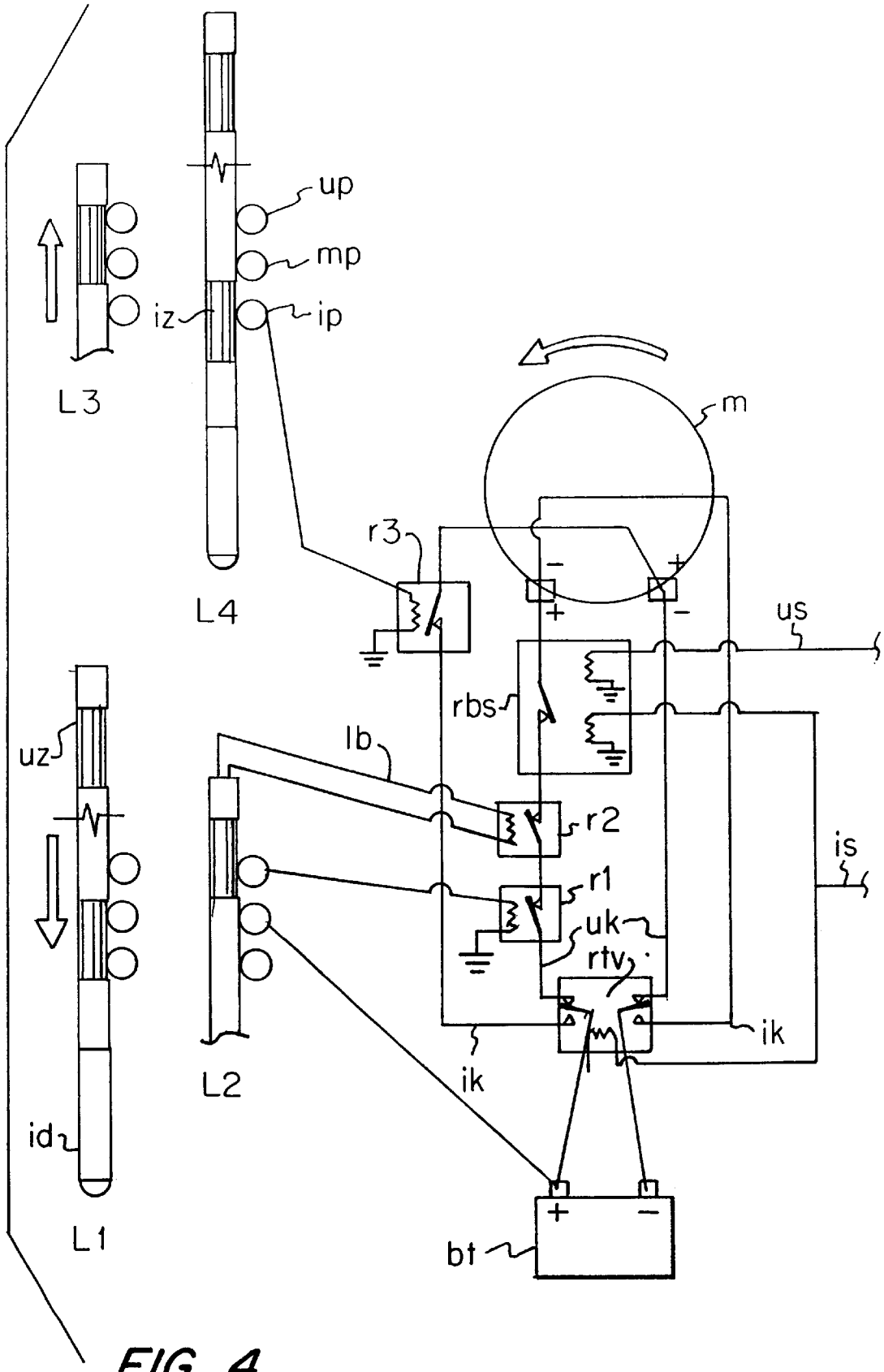
FIG. 4 illustrates the electrical control circuit for the cable winder in FIGS. 3, 3A, 3B, 3C and 3D.

FIG. 4 shows the electrical circuit in the extension device that consists of two sub-circuits. One sub-circuit (uk) to drive the electric motor (m) in a direction that causes extension of the cable and one sub-circuit (ik) to drive the same motor in the other direction for retraction of the cable (dk). FIG. 4 also shows the three control points (ip, mp, up) drawn four times for four different cable positions and the middle control point (mp) in this example is fed with current from the vehicle battery (bt). FIG. 4 shows that only one sub-circuit can be active at any given time via the bipolar relay (rtv). FIG. 4 illustrates how an electric extension signal (us) causes the breaker device which in this example is the bistable relay (rbs) to close the circuit (uk) which causes the motor (m) to rotate in the direction that extends the cable (dk) from position (L1) to position (L2) just before extension is complete. Thereafter, in position (L3), the extension zone (uz) is tangent close to the cable's fixed end's extension point (up) and input point (mp) which causes (up) to become live and the breaker device or, in this example, the relay (ri) to break the current to the electric motor. If the input device (id) at the cable's free end completes the connection with the output device in the receiver and current is carried by the wiring accommodated by the cable via the wires (lb), the breaker device (r2) will break the current to the electric motor. Retraction can begin when the cable is in position (L2) or in position (L3) via retraction current in the wiring (is) in part causing the breaker device—the bistable relay—(rbs) to break the circuit (uk) and in part cause the bipolar relay (rtv) to close the current to the electrical sub-circuit (ik). This causes the motor (m) to rotate in the opposite direction and retract the cable (dk) until the retraction zone (iz) is tangent with input point (mp) and the retraction point (ip) just after position (L4) i.e. initial position (L1) which causes retraction point (ip) to become live causing relay (r3) to break current in sub-circuit (ik) and cause the motor (m) to stop.

Figure 5B:
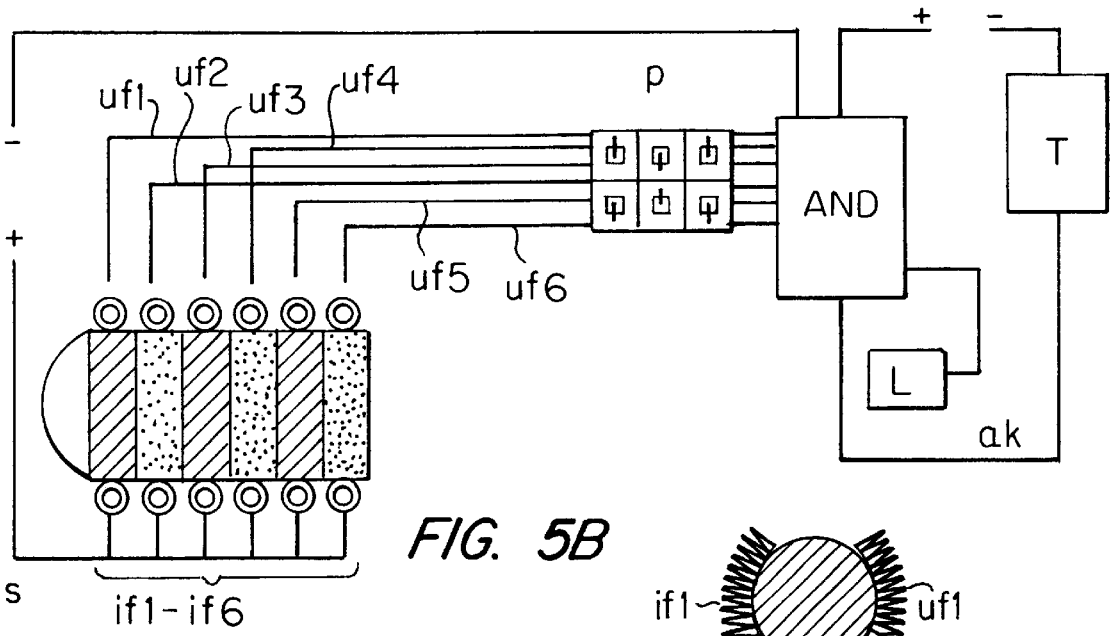
FIGS. 5A, 5B, 5C, 5D, 5E and 5F show a programmable input device and a method or programming of the affiliated output device.
Figure 5A:
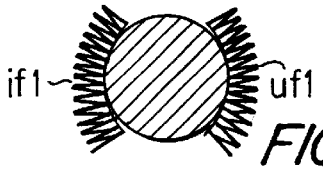
Figure 5F:
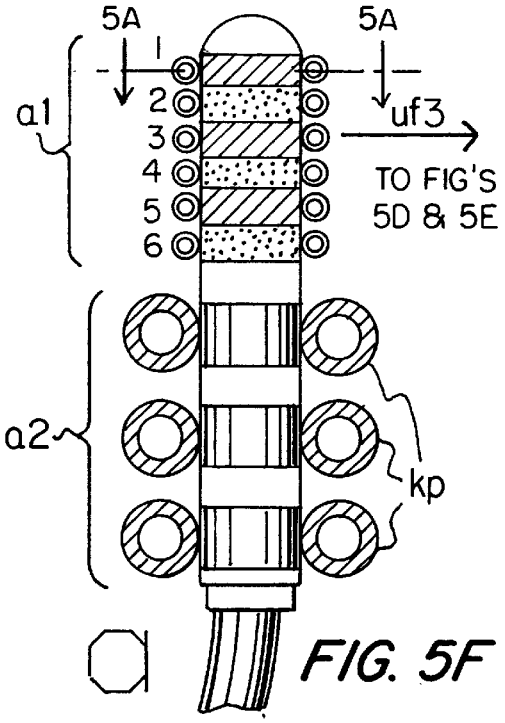

FIGS. 5A, 5B, 5C, 5D, 5E and 5F show a programmable connection device, more specifically a contact device for transfer of electricity from the utility electric supply. FIG. 5F shows the input device with the coding part (a1) and the contact part (a2). The input device is drawn together with the input and output points in the coding part (a1) plus the utility electric supply contact points (kp) clearly insulated from the output device (not shown). All contact points (kp) consist of parallel springs the axes of which form a 90-degree angle to the input device's axle which results in a flexible contact and allows introduction of the input device into the output device without appreciable pressure. FIG. 5A, a cross-section along the line 5A–5A of FIG. 5F shows the input and output points (if1, uf1) for the code element (1) in the form of two springs that are pressed aside when the input device is introduced. The code element in the input device consists of 6 different exchangeable cylinders that are mounted on an axle of which 3 (1, 3 and 5) are electrically conductive and 3 are non-electrically conductive (2, 4 and 6). A change in the input device's binary code can be made via a change in the order of the cylinders or a change of one or several cylinders.

Figure 5D:
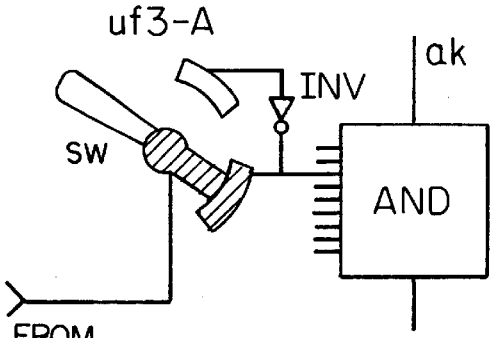
Figure 5E:
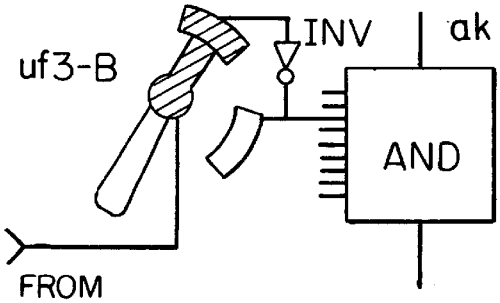
Figure 5C:
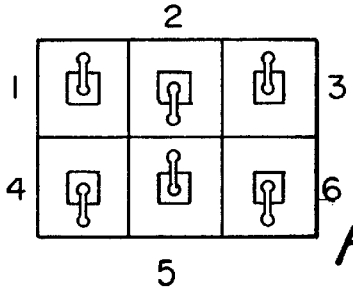

The input points of the code reading device are powered by a suitable electricity supply. The output points (uf1) to (uf6) in FIG. 5B will only be live if the corresponding tested code elements are electrically conductive. All output points are connected, in FIG. 5B, to the control block (p) that is shown in enlarged in FIG. 5C. It is comprised of 6 bipolar toggle switches (1 through 6); one for each output point. The control block (p) allows programming of a binary authorization value for all of the 64 possible contacts for the device, i.e. $2^6$. FIG. 5D shows the control block for output point (uf3) set at value 1 via connection to the AND-gate via switch (sw) in position (uf3-A). The other position for switch (sw) is (uf3-B) which connects the output point to the AND-gate via the inverter (INV). When the key's binary value corresponds with the authorization value to be activated the AND-gate closes the electrical circuit (ak) which activates the locking and/or connection mechanism. In this case, a relay (T) closes current to the contact points (kp). If the above-named binary value is different, the electrical circuit (ak) remains broken because the AND-gate does not close the same circuit and an alarm or light signal is activated by means of suitable device (L).

Figure 6A:
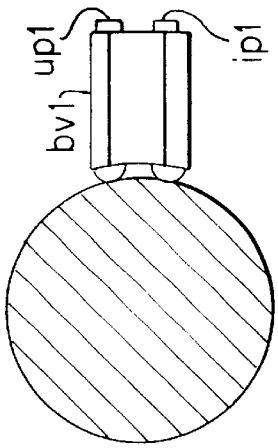
FIGS. 6, 6A and 6B is another method for programming of the output device.
Figure 6B:
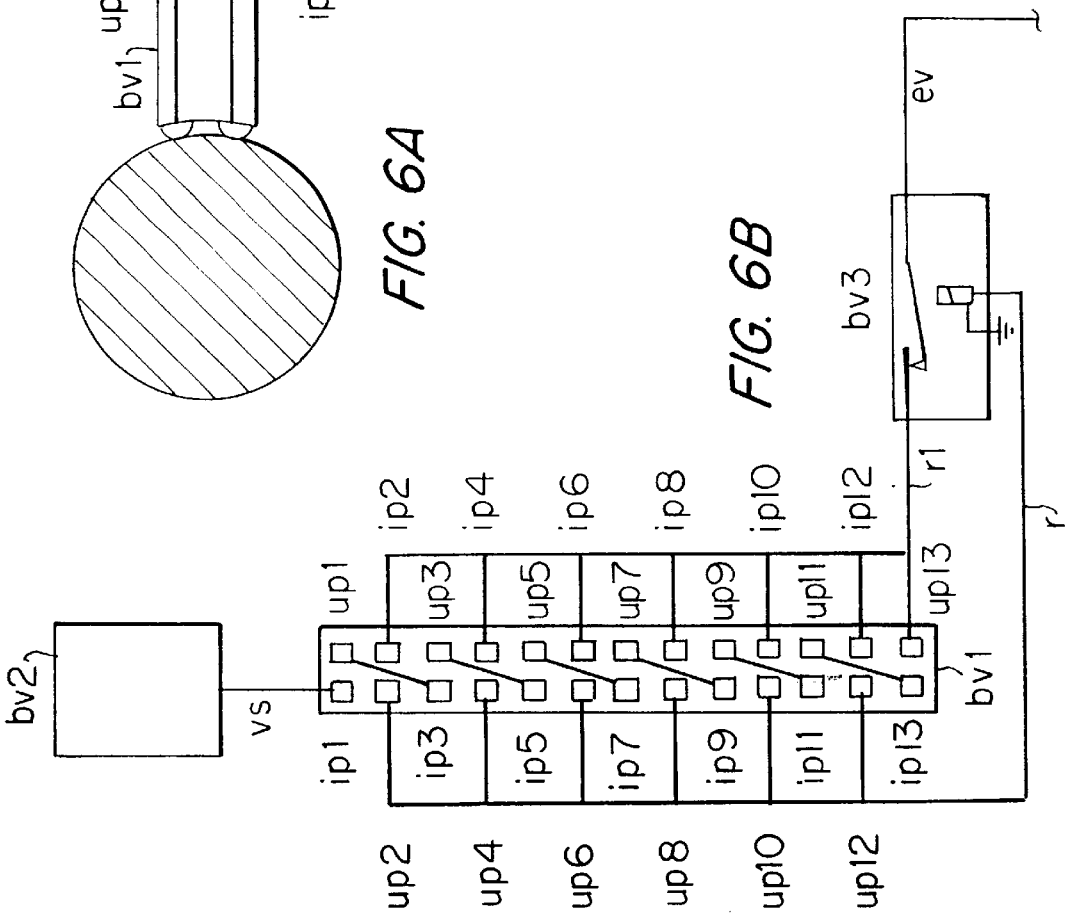
Figure 6:
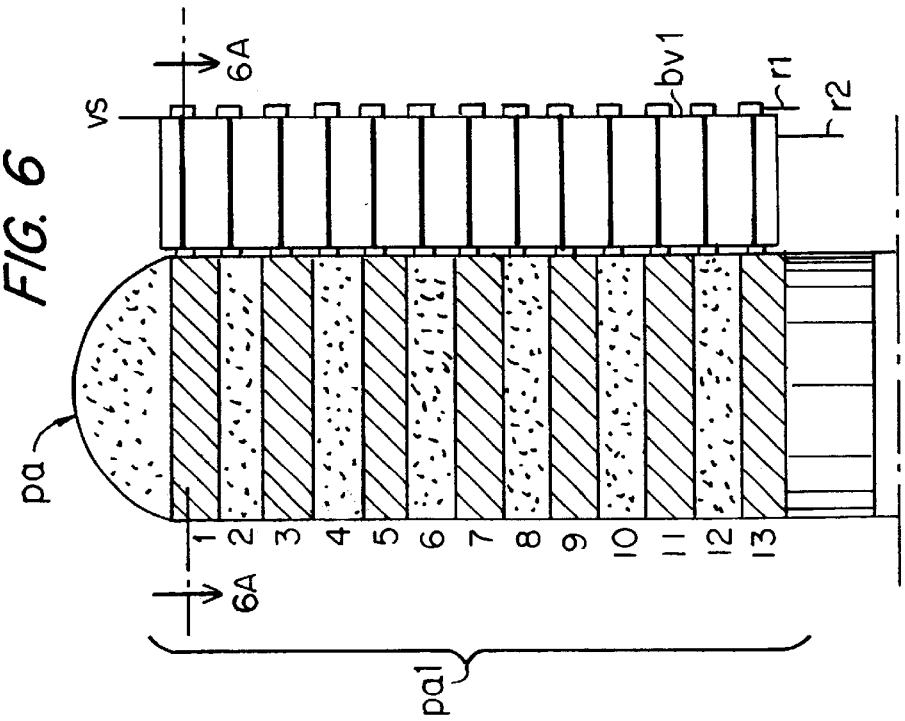

FIGS. 6, 6A and 6B show the code part (pa 1) of a connection input device (pa) that consists of 13 code elements which means $2^{13}$=8192 different code combinations. 7 code elements odd numbers—are electrically conductive and 6—even numbers—are non-conductive. Input and output points are mounted in the input device's code reading device (bv1) as shown separated from the output device and are fed with current from the power supply (bv2). FIG. 6A, a cross-section along the line 6A–6A of FIG. 6, shows input and output points for code element (1). FIG. 6B shows how 1-code reading elements (1, 3, 5, 7, 9 and 11) are serially connected via the connection of each 1-output point to the following 1-input points (up1-ip3, up3-ip5 . . . up13). The code reading device is connected to power supply (bv2) via 1-input point (ip1). The contact of the corresponding code reading element input points with respective electrically conductive code elements results in current in the wiring (r1) which constitutes the first condition for the connection of the input device. 0-code reading elements (2, 4, 6, 8 and 10) are connected in parallel and all of these input points (ip2 to ip12) will be live when the first condition above is satisfied. This results in, providing all corresponding code elements are not electrically conductive, the absence of current in all output points (up2 to up12) and thereby wire (r2) will not be live which constitutes the second condition for connection of the input device. Wires (r1) and (r2) are connected to the relay (bv3) that activates the connection mechanism by means of the current in the wire (ev) upon satisfaction of the same above-named conditions.

What is claimed is:

1. An automatic connection system for the transfer for energy, gas or liquid fuel to a mobile vehicle comprising:

(a) a stationary connection output device equipped with a receiver device and a code reading device, the code reading device is able to recognize a coded connection input device corresponding to the connection output device, the code reading device is able to activate a transfer mechanism to initiate the transfer of energy, gas or liquid fuel from the output device to the input device; and (b) an arrangement mounted in the mobile vehicle comprising a cable and a cable extension device, the cable adapted for extension from the mobile vehicle to achieve connection with the stationary connection output device when the mobile vehicle is positioned adjacent the stationary connection output device, the cable being at least semi-rigid and at least semi-elastic, the cable comprising conduits for energy, gas or liquid fuel and having one free end with an affixed coded input device corresponding to the stationary connection output device, the extension mechanism is able to apply a force on the cable extending the cable so that the cable extends a distance between initial positions of the affixed coded input device and the stationary connection output device when the mobile vehicle is positioned adjacent the stationary connection output device and propagating at least part of the force by means of rigidity of the cable to the affixed coded input device forcing the input device through the receiver device, correcting initial direction of the affixed coded input device and forcing the affixed coded input device into the stationary connection output device.

2. A system in accordance with claim 1, wherein the semi-rigidity and semi-elasticity of the cable are achieved by a spiral casing primarily a spring of a length at least equal to the distance between the initial position of the input device after parking the vehicle and the stationary output device.

3. A system in accordance with claim 1, wherein the output device is provided with the transfer mechanism to lock the input device upon activation of the transfer mechanism to achieve a requisite connection between the transfer mechanism and the input device.

4. A system in accordance with claim 1, wherein the receiver device is selected from the group consisting of at least one channel, a tapering channel, a tapering pipe, a funnel, a curved, tapering channel, a curved tapering pipe and a trumpet-shaped channel, that via a cross-section can receive the cable and allow the cable to pass therethrough and through the receiver device, in an extension direction of the cable, subsequent cross-sections facilitate connection between the input and output devices when the cable is extended in a direction that differs from that of the output device.

5. A system in accordance with claim 1, wherein the coded connection input device has a code with several elements with differing physical properties in a defined order and the corresponding code reading device of the output device activates the transfer mechanism upon introduction of the input device if the corresponding code reading device recognizes the code.

6. A system in accordance with claim 5, wherein the code for the input device can be programmed mechanically and the corresponding code reading device can be programmed by means of a device intended for this purpose.

7. A system in accordance with claim 1, wherein the input device is coded with at least one energy connection element which, upon introduction into the output device, activates the transfer mechanism.

8. A system in accordance with claim 1, wherein the receiver device has at least one device powered by current via at least one live element in the input device thereby increasing safety in use of the connection system.

9. A system in accordance with claim 1, wherein the extension device includes an extension and retraction mechanism which in part causes the cable to stop upon reaching a connection position and in part stops the cable when the cable reaches an idle position within the extension device.

10. A system in accordance with claim 9, wherein extension of the cable ceases when the input device reaches the connection position with the output device in the receiver device by means of a transmitted signal in at least one conduit specifically intended for this purpose.

11. A system in accordance with claim 9, wherein extension of the cable ceases when the input device reaches the connection position with the output device in the receiver device by means of a change in pressure in a hose-pipe.

12. A system in accordance with claim 1, wherein the input device has electrical contact points which are springs, the springs having axes in a plane which forms an angle to an axis of the input device that is between 0 and 90 degrees, and of which at least one can at least partially enclose the input device to achieve a flexible contact and facilitate introduction of the input device into the output device.

13. A system in accordance with claim 1, wherein the input device has code contact points which are springs, the springs having axes in a plane which forms an angle to an axis of the input device that is between 0 and 90 degrees, and of which at least one can at least partially enclose the input device to achieve a flexible contact and facilitate introduction of the input device into the output device.

14. A system in accordance with claim 1, wherein the extension device is comprised of:

cable winder for extension and retraction of the cable, receptacle for the transferred energy, gas or liquid fuel, and device to rotate the cable winder for extension and retraction of the cable.

15. A system in accordance with claim 1, wherein the transfer mechanism is associated with the cable to allow an intended transfer from the input device to the output device through the cable when connection between the input and output devices is completed.

16. An automatic connection system for the transfer for energy comprising:

(a) an arrangement mounted in the vehicle comprising a cable intended for extension from the vehicle to achieve connection with a stationary connection output device equipped with a cable receiver outside the vehicle, and a cable extension mechanism, the cable being at least partially rigid and at least partially elastic, the cable comprising conduits for energy and having one free end intended to achieve the connection by an affixed coded input device, the extension mechanism able to apply a force on the cable extending the cable to bridge the entire distance between initial positions of the input device and a stationary output connection device and propagating at least part of the force by means of rigidity of the cable to the input device forcing the input device through the receiver, correcting initial direction and forcing the input device into the stationary connection output device; and (b) a stationary connection output device equipped with a receiver device for reception of the free end of the cable equipped with the input device, the output device having a corresponding code reading device able to register that the input device of the cable is intended for connection with the output device and belongs to the connection system, the reading device is able to activate a transfer mechanism to initiate the transfer of energy from output device to the input device.

17. A system in accordance with claim 16, wherein at least one part of the transfer of energy between the input device and the output device occurs inductively via one suitable device to achieve greater user safety.

18. A system in accordance with claim 16, wherein the input device has electrical contact points which are springs, the springs having axes in a plane which forms an angle to an axis of the input device that is between 0 and 90 degrees, and of which at least one can at least partially enclose the input device to achieve a flexible contact and facilitate introduction of the input device into the output device.

19. A system in accordance with claim 16, wherein the input device has code contact points which are springs, the springs having axes in a plane which forms an angle to an axis of the input device that is between 0 and 90 degrees, and of which at least one can at least partially enclose the input device to achieve a flexible contact and facilitate introduction of the input device into the output device.

20. A system in accordance with claim 16, wherein the extension device is comprised of:

cable winder for extension and retraction of the cable, receptacle for the transferred energy, gas or liquid fuel, and device to rotate the cable winder for extension and retraction of the cable.

21. A system in accordance with claim 16, wherein the transfer mechanism is associated with the cable to allow an intended transfer from the input device to the output device through the cable when connection between the input and output devices is completed.

22. A method for the automatic transfer of energy, gas or liquid fuel to a vehicle comprising:

(a) providing an automatic connection system comprising:

(i) an arrangement mounted in the vehicle comprising an extendable cable and a cable extension mechanism, the cable being at least semi-rigid and at least semi-elastic, the cable comprising conduits for energy, gas or liquid fuel and having one free end intended to achieve the connection by means of an affixed coded input device; and (ii) a corresponding stationary connection output device equipped with a receiver device for the reception of the free end of the cable equipped with the input device, the output device having a corresponding code reading device able to register that the input device of the cable is intended for connection with the output device and belongs to the connection system, the reading device is able to activate a transfer mechanism to initiate the intended transfer;

(b) parking the vehicle, simultaneously positioning the input device so that the distance between the input and stationary output devices is less than the extendable length of the cable;

(c) activating the extension device and thereby applying an extension force to the cable forcing the cable out of the vehicle;

(d) using the same extension force, partly to bridge the distance between the input device and the receiver of the stationary output device and partly to force the input device by means of the receiver to be aligned with the output device and to enter the output device;

(e) using the corresponding code reading device to register that the input device is intended for connection with the output device;

(f) after successful identification of the input device, activating the transfer mechanism to initiate the transfer of energy, gas or liquid fuel from the output device to the input device; and (g) regaining the mobility of the vehicle by retracting the cable back to the vehicle by utilizing the extension device.

23. A system in accordance with claim 22, wherein semi-elasticity and stiffness of the cable are achieved by a spiral casing primarily a spring of a length at least equal to the distance between initial positions of the input device after parking the vehicle and the stationary output device.

24. A method in accordance with claim 22, wherein the output device locks the input device upon the activation of the transfer mechanism to achieve a requisite connection between the transfer mechanism and the input device.

25. A method in accordance with claim 22, wherein the receiver device is selected from a group consisting of at least one channel, a tapering channel, a tapering pipe, a funnel, a curved, tapering channel, a curved tapering pipe and a trumpet shaped channel, that via a cross-section receives the cable and allows the cable to pass therethrough and through the receiver device, subsequent cross-sections rendering the cable and aligning the input device with the output device to facilitate connection thereof.

26. A method in accordance with claim 22, wherein the input device is coded with at least two elements with differing physical properties in a defined order and is recognized by the corresponding code reading device upon introduction of the input device in the output device.

27. A method in accordance with claim 22, wherein the code for the input device can be programmed mechanically and the corresponding code reading device can be programmed by means of a device intended for this purpose.

28. A method in accordance with claim 22, wherein the input device is coded with at least one energy transfer element which, upon introduction into the output device, activates the transfer mechanism.

29. A method in accordance with claim 22, wherein the input device is provided with at least one live element to power at least one of the devices connected to the output device thereby increasing safety.

30. A method in accordance with claim 22, wherein the extension device includes an extension and retraction mechanism which in part causes the cable to stop upon reaching a connection position and in part stops the cable when the cable reaches an idle position within the extension device.

31. A method in accordance with claim 30, wherein extension of the cable ceases when the input device reaches the connection position with the output device by means of transmitted signal in cable wiring.

32. A method in accordance with claim 30, wherein extension of the cable ceases when the input device reaches the connection position with the output device by means of transmitted signal in at least one conduit specifically intended for this purpose.

33. A method in accordance with claim 30, wherein extension of the cable ceases when the input device reaches the connection position with the output device by means of change in pressure in a hose-pipe in the cable.

34. A method in accordance with claim 22, wherein at least one part of the transfer of energy between the input device occurs inductively via one suitable device to achieve greater user safety.

35. A method in accordance with claim 22, wherein the output device has electrical contact points which are springs having axes in a plane which forms an angle to an axes of the input device that is between 0 and 90 degrees, and of which at least one can at least partially enclose the input device to achieve a flexible contact and facilitate the introduction of the input device into the output device.

36. A method in accordance with claim 22, wherein the output device has code contact points which are springs having axes in a plane which forms an angle to an axes of the input device that is between 0 and 90 degrees, and of which at least one can at least partially enclose the input device to achieve a flexible contact and facilitate the introduction of the input device into the output device.

37. A method in accordance with claim 22, wherein the output and the receiver devices are mounted on another vehicle.

38. A method in accordance with claim 22, wherein the transfer mechanism is associated with the cable to allow an intended transfer from the input device to the output device through the cable when connection between the input and output device is completed.

* * * * *

UNITED STATES PATENT AND TRADEMARK OFFICE

CERTIFICATE OF CORRECTION

PATENT NO. : 6,439,275 B1
DATED : August 27, 2002
INVENTOR(S) : Abdullah Alhomsi It is certified that error appears in the above-identified patent and that said Letters Patent is hereby corrected as shown below:

Column 6,
Line 34, "The same" should be deleted.
Line 57, "(ri)" should be -- (r1) --.

Signed and Sealed this

Eleventh Day of February, 2003

JAMES E. ROGAN
*Director of the United States Patent and Trademark Office*